US007767049B2

(12) United States Patent
Sadlier

(10) Patent No.: US 7,767,049 B2
(45) Date of Patent: Aug. 3, 2010

(54) MULTI-LAYERED CONTAINER HAVING INTERRUPTED CORRUGATED INSULATING LINER

(75) Inventor: Claus E. Sadlier, Pleasanton, CA (US)

(73) Assignee: Dixie Consumer Products LLC, Atlanta, GA (US)

( * ) Notice: Subject to any disclaimer, the term of this patent is extended or adjusted under 35 U.S.C. 154(b) by 653 days.

(21) Appl. No.: 11/548,916

(22) Filed: Oct. 12, 2006

(65) Prior Publication Data

US 2008/0087716 A1 Apr. 17, 2008

(51) Int. Cl.
*B31F 1/22* (2006.01)
*B65D 3/22* (2006.01)

(52) U.S. Cl. ..... 156/205; 156/212; 229/403; 229/939

(58) Field of Classification Search ..... 229/4.5, 229/403, 939; 156/183, 205–208, 212, 214
See application file for complete search history.

(56) References Cited

U.S. PATENT DOCUMENTS

| | | | |
|---|---|---|---|
| 139,688 | A | 6/1873 | Norton |
| 154,498 | A | 8/1874 | Long |
| 411,096 | A | 9/1889 | Eaton et al. |
| 472,463 | A | 4/1892 | Mark |
| 495,422 | A | 4/1893 | Meech |
| 502,951 | A | 8/1893 | Clark |
| 536,545 | A | 5/1895 | Schmidt |
| 546,179 | A | 9/1895 | McEwan |
| 563,962 | A | 7/1896 | Hinde |
| 858,385 | A | 7/1907 | Haefely |
| 901,334 | A | 10/1908 | Flipse |
| 950,785 | A | 3/1910 | Pene |
| 1,025,659 | A | 5/1912 | Vargyas et al. |
| 1,032,557 | A | 7/1912 | Luellen |
| 1,032,789 | A | 7/1912 | Swift, Jr. |
| 1,039,723 | A | 10/1912 | Gage |
| 1,067,237 | A | 7/1913 | Brandt |
| 1,091,526 | A | 3/1914 | Moore |
| 1,098,178 | A | 5/1914 | Semple |
| 1,100,809 | A | 6/1914 | Wilson |
| 1,106,005 | A | 8/1914 | Shevlin |
| 1,158,581 | A | 11/1915 | Swift, Jr. |
| 1,167,861 | A | 1/1916 | Vincent |
| 1,189,140 | A | 6/1916 | Lane |
| 1,208,483 | A | 12/1916 | Chesbrough |
| 1,216,617 | A | 2/1917 | Shevlin |
| 1,229,751 | A | 6/1917 | House |
| 1,243,658 | A | 10/1917 | Ford |

(Continued)

FOREIGN PATENT DOCUMENTS

| | | |
|---|---|---|
| CA | 667719 | 1/1964 |

(Continued)

OTHER PUBLICATIONS

Walter Soroka, Fundamentals of Packaging, 1995, p. 296-301; Publisher: Richard Warrington, USA.

(Continued)

*Primary Examiner*—Gary E Elkins

(57) ABSTRACT

The present invention relates to insulated containers useful for serving, for example, hot beverages. Specifically, the present invention relates to multilayer containers comprising a corrugated sheet as an inner insulating liner wherein the liner comprises interruptions.

12 Claims, 3 Drawing Sheets

U.S. PATENT DOCUMENTS

| | | | |
|---|---|---|---|
| 1,284,728 | A | 11/1918 | Luellen |
| 1,294,210 | A | 2/1919 | Wallertz |
| 1,295,418 | A | 2/1919 | Bohlman |
| 1,297,152 | A | 3/1919 | Hackney |
| 1,308,793 | A | 7/1919 | Luellen |
| 1,334,302 | A | 3/1920 | Hicks |
| 1,444,397 | A | 2/1923 | Seigle |
| 1,588,123 | A | 6/1926 | Maston |
| 1,615,254 | A | 1/1927 | Barker |
| 1,654,982 | A | 1/1928 | Luellen |
| 1,665,033 | A | 4/1928 | Jensen |
| 1,692,951 | A | 11/1928 | Pickney |
| 1,732,322 | A | 10/1929 | Wilson et al. |
| 1,771,765 | A | 7/1930 | Benson |
| 1,845,891 | A | 2/1932 | Schroeder |
| 1,850,013 | A | 3/1932 | Hinkley |
| 1,919,569 | A | 7/1933 | Oliver |
| 1,924,873 | A | 8/1933 | Moone |
| 1,940,406 | A | 12/1933 | Ericson |
| 1,955,745 | A | 4/1934 | Hurley |
| 1,962,199 | A | 6/1934 | Koch et al. |
| 2,017,810 | A | 10/1935 | Bodar et al. |
| 2,037,675 | A | 4/1936 | Boothby et al. |
| RE20,034 | E | 7/1936 | Ives |
| 2,051,076 | A | 8/1936 | Deakin |
| 2,055,877 | A | 9/1936 | Palmer |
| 2,075,465 | A | 3/1937 | Powell |
| 2,084,922 | A | 6/1937 | Sidebotham |
| 2,103,831 | A | 12/1937 | Sidon |
| 2,155,487 | A | 4/1939 | Hatch |
| 2,237,809 | A | 4/1941 | Bronson |
| 2,246,426 | A | 6/1941 | Wickstrom |
| 2,253,718 | A | 8/1941 | McKeage |
| 2,266,828 | A | 12/1941 | Sykes |
| 2,300,473 | A | 11/1942 | Van Winkle |
| 2,336,158 | A | 12/1943 | Bell |
| 2,347,236 | A | 4/1944 | Barbieri |
| 2,349,730 | A | 6/1944 | Horning |
| 2,354,098 | A | 7/1944 | Bamber |
| 2,389,547 | A | 11/1945 | Ringler |
| 2,416,813 | A | 3/1947 | Barbieri |
| 2,437,114 | A | 3/1948 | Moore |
| 2,444,861 | A | 7/1948 | Symmes |
| 2,453,159 | A | 11/1948 | Richter |
| 2,457,198 | A | 12/1948 | Bell |
| 2,501,815 | A | 3/1950 | Hamm |
| 2,503,874 | A | 4/1950 | Ives |
| 2,512,602 | A | 6/1950 | Bell |
| 2,563,352 | A | 8/1951 | Morse |
| 2,589,645 | A | 3/1952 | Tiegel |
| 2,591,578 | A | 4/1952 | McNealy et al. |
| 2,617,549 | A | 11/1952 | Egger |
| 2,623,680 | A | 12/1952 | Wilcox |
| 2,623,681 | A | 12/1952 | Wilcox |
| 2,641,402 | A | 6/1953 | Brunn |
| 2,642,372 | A | 6/1953 | Chittick |
| 2,653,887 | A | 9/1953 | Slayter |
| 2,661,889 | A | 12/1953 | Phinney |
| 2,686,555 | A | 8/1954 | Howard |
| 2,695,744 | A | 11/1954 | Gattuso |
| 2,719,662 | A | 10/1955 | Minteer et al. |
| 2,727,674 | A | 12/1955 | Rous |
| 2,755,983 | A | 7/1956 | Ringler |
| 2,758,047 | A | 8/1956 | Dowd |
| 2,775,384 | A | 12/1956 | Bergstrom |
| 2,805,808 | A | 9/1957 | Brewer |
| 2,828,903 | A | 4/1958 | Adkins |
| 2,830,005 | A | 4/1958 | Jackson |
| 2,841,402 | A | 7/1958 | Bruun |
| 2,842,301 | A | 7/1958 | Albert |
| 2,853,222 | A | 9/1958 | Gallagher |
| 2,917,215 | A | 12/1959 | Psaty et al. |
| 2,954,913 | A | 10/1960 | Rossman |
| 2,969,901 | A | 1/1961 | Behrens |
| 2,989,218 | A | 6/1961 | Bergstrom |
| 3,001,683 | A | 9/1961 | Goodwin |
| 3,049,277 | A | 8/1962 | Shappell |
| 3,079,027 | A | 2/1963 | Edwards |
| 3,082,900 | A | 3/1963 | Goodman |
| 3,083,891 | A | 4/1963 | Forrer |
| 3,089,630 | A | 5/1963 | Garvin |
| 3,106,237 | A | 10/1963 | Karl |
| 3,106,327 | A | 10/1963 | Karl |
| 3,123,273 | A | 3/1964 | Miller |
| 3,126,139 | A | 3/1964 | Schechter |
| 3,141,913 | A | 7/1964 | Edwards |
| 3,145,131 | A | 8/1964 | Finke |
| 3,156,401 | A | 11/1964 | Krause |
| 3,157,336 | A | 11/1964 | Elam |
| 3,157,337 | A | 11/1964 | Elam |
| 3,162,347 | A | 12/1964 | Taylor |
| 3,178,088 | A | 4/1965 | Herr |
| 3,182,794 | A | 5/1965 | Moore |
| 3,194,468 | A | 7/1965 | Baron |
| 3,203,611 | A | 8/1965 | Anderson at al. |
| 3,237,834 | A | 3/1966 | Davis at al. |
| 3,242,829 | A | 3/1966 | White |
| 3,248,289 | A | 4/1966 | White |
| 3,254,827 | A | 6/1966 | Chapman |
| 3,279,675 | A | 10/1966 | Elam et al. |
| 3,317,110 | A | 5/1967 | Palmer |
| 3,372,830 | A | 3/1968 | Edwards |
| 3,383,025 | A | 5/1968 | Ferrey et al. |
| 3,385,502 | A | 5/1968 | Pilger |
| 3,394,800 | A | 7/1968 | Brackett et al. |
| 3,400,029 | A | 9/1968 | Mesrobian et al. |
| 3,410,473 | A | 11/1968 | Petrie |
| 3,414,184 | A | 12/1968 | Loheed |
| 3,428,239 | A | 2/1969 | Wannamaker et al. |
| 3,443,681 | A | 5/1969 | Wysocki |
| 3,443,714 | A | 5/1969 | Edwards |
| 3,443,715 | A | 5/1969 | Edwards |
| 3,456,860 | A | 7/1969 | Janninck |
| 3,456,863 | A | 7/1969 | Mollison et al. |
| 3,503,310 | A | 3/1970 | Goetz |
| 3,520,463 | A | 7/1970 | Ahlemeyer |
| 3,580,468 | A | 5/1971 | McDevitt |
| 3,581,972 | A | 6/1971 | Buchner et al. |
| 3,670,946 | A | 6/1972 | Croley |
| 3,712,530 | A | 1/1973 | Croley |
| 3,779,157 | A | 12/1973 | Ross et al. |
| 3,785,254 | A | 1/1974 | Mann |
| 3,816,206 | A | 6/1974 | Coster |
| 3,819,085 | A | 6/1974 | Rohowetz |
| 3,836,063 | A | 9/1974 | Sutch |
| 3,846,220 | A | 11/1974 | Buchner |
| 3,861,530 | A | 1/1975 | Calvert |
| 3,868,043 | A | 2/1975 | Freemayer |
| 3,890,762 | A | 6/1975 | Ernst et al. |
| 3,908,523 | A | 9/1975 | Shikaya |
| 3,927,766 | A | 12/1975 | Day |
| 3,988,521 | A | 10/1976 | Fumel et al. |
| 4,040,537 | A | 8/1977 | Edwards |
| 4,080,880 | A | 3/1978 | Shikaya |
| RE29,898 | E | 2/1979 | Wheeler |
| 4,146,660 | A | 3/1979 | Hall et al. |
| 4,150,186 | A | 4/1979 | Kazama |
| 4,150,747 | A | 4/1979 | Gordon |
| 4,163,508 | A | 8/1979 | Mannor |
| 4,170,172 | A | 10/1979 | Wommelsdorf |
| 4,170,674 | A | 10/1979 | Matsuki |
| 4,171,085 | A | 10/1979 | Doty |
| 4,176,054 | A | 11/1979 | Kelley |
| 4,187,137 | A | 2/1980 | Beauchamp |

4,187,954 A 2/1980 Striggow
4,200,219 A 4/1980 Ramich
4,228,918 A 10/1980 Kellogg
4,239,125 A 12/1980 Pawlowski
4,243,156 A 1/1981 Lobbestael
4,254,173 A 3/1981 Peer, Jr.
4,261,501 A 4/1981 Watkins
D259,231 S 5/1981 Kozlow
4,270,443 A 6/1981 McSwiney et al.
4,300,963 A 11/1981 Berg
4,311,746 A 1/1982 Chavannes
4,319,680 A 3/1982 Hiemstra
4,328,891 A 5/1982 Elward
4,343,259 A 8/1982 McConnel
4,347,934 A 9/1982 Goodman
4,379,014 A 4/1983 Rausing et al.
4,385,997 A 5/1983 Stradal
4,398,650 A 8/1983 Holmes et al.
4,398,904 A 8/1983 Faberberg
4,412,629 A 11/1983 Dart et al.
4,429,825 A 2/1984 Kipp
4,432,488 A 2/1984 Dutcher
4,452,596 A 6/1984 Clauss et al.
4,456,649 A 6/1984 Clarke
D275,636 S 9/1984 Picozza
4,495,011 A 1/1985 Scharfenberg et al.
4,505,769 A 3/1985 Auckenthaler
4,511,078 A 4/1985 Rausér et al.
D279,850 S 7/1985 Brooker et al.
4,526,316 A 7/1985 Sutherland
4,526,566 A 7/1985 Briand
4,531,996 A 7/1985 Sukenik
4,535,919 A 8/1985 Jameson
4,541,526 A 9/1985 Berg et al.
D281,758 S 12/1985 Trombly
4,556,166 A 12/1985 Penttilä
4,558,813 A 12/1985 Richards
4,558,815 A 12/1985 Wischusen, III
4,574,997 A 3/1986 Ikeda
4,578,329 A 3/1986 Holsappel
4,589,569 A 5/1986 Clements
4,617,211 A 10/1986 Fries, Jr.
4,623,072 A * 11/1986 Lorenz ..... 229/939
D287,919 S 1/1987 Clements
4,667,844 A 5/1987 Clauss
4,700,862 A 10/1987 Carter et al.
4,702,496 A 10/1987 Hume, III
4,714,164 A 12/1987 Bachner
4,715,527 A 12/1987 Tsuzuki et al.
4,756,440 A 7/1988 Gartner
4,778,696 A 10/1988 King
4,782,975 A 11/1988 Coy
4,792,086 A 12/1988 Chen
4,836,400 A 6/1989 Chaffey et al.
4,842,906 A 6/1989 Ekdahl et al.
4,858,782 A 8/1989 Yasymuro et al.
4,868,057 A 9/1989 Himes
4,875,585 A 10/1989 Kadleck et al.
4,925,440 A 5/1990 Müller
4,932,531 A 6/1990 Bakx
4,934,591 A 6/1990 Bantleen
4,955,531 A 9/1990 Graboyes
4,961,510 A 10/1990 Dvoracek
4,993,580 A 2/1991 Smith
4,997,125 A 3/1991 Glerum
4,998,666 A 3/1991 Ewan
5,000,788 A 3/1991 Stotler
5,001,179 A 3/1991 Kauffman et al.
5,029,749 A 7/1991 Aloisi
5,067,887 A 11/1991 Speer et al.
5,078,313 A 1/1992 Matheson
5,092,485 A 3/1992 Lee
5,098,962 A 3/1992 Bozich
5,102,036 A 4/1992 Orr et al.
5,111,957 A 5/1992 Hollander et al.
5,145,107 A 9/1992 Silver et al.
5,203,492 A 4/1993 Schellenberg
5,205,473 A 4/1993 Coffin
5,209,367 A 5/1993 Van Musscher et al.
5,222,656 A 6/1993 Carlson
5,226,585 A 7/1993 Varano
5,229,182 A 7/1993 Eisman et al.
D339,027 S 9/1993 Mack et al.
5,244,093 A 9/1993 Carmichael et al.
5,253,781 A 10/1993 Van Melle et al.
5,256,131 A 10/1993 Owens et al.
5,259,529 A 11/1993 Coale
5,326,019 A 7/1994 Wolff
5,363,982 A 11/1994 Sadlier
5,385,260 A 1/1995 Gatcomb
5,398,842 A 3/1995 Sokolski et al.
5,398,843 A 3/1995 Warden et al.
5,415,339 A 5/1995 Howard
5,425,497 A 6/1995 Sorensen
5,429,239 A 7/1995 Baxter
D363,641 S 10/1995 Goto et al.
5,454,484 A 10/1995 Chelossi
5,458,723 A 10/1995 Watkins et al.
5,460,323 A 10/1995 Titus
5,460,324 A 10/1995 Vinther
D363,852 S 11/1995 Young
D364,071 S 11/1995 Lynd
5,469,983 A 11/1995 Yawata
5,484,059 A 1/1996 Sutherland
5,487,506 A 1/1996 Drummond et al.
5,490,631 A 2/1996 Iioka et al.
D368,624 S 4/1996 Forrer
5,509,568 A 4/1996 Warden et al.
5,524,817 A 6/1996 Meier et al.
5,542,599 A 8/1996 Sobol
5,547,124 A 8/1996 Mueller
5,620,135 A 4/1997 Stahlecker et al.
5,628,453 A 5/1997 MacLaughlin
D379,928 S 6/1997 Freek et al.
5,660,326 A 8/1997 Varano et al.
5,685,480 A 11/1997 Choi
5,697,550 A 12/1997 Varano et al.
5,713,512 A 2/1998 Barrett
5,725,916 A 3/1998 Ishii et al.
5,746,372 A 5/1998 Spence
5,750,235 A 5/1998 Yoshimasa
5,752,653 A 5/1998 Razzaghi
RE35,830 E 6/1998 Sadlier
5,759,624 A 6/1998 Neale et al.
5,765,716 A 6/1998 Cai et al.
5,766,709 A 6/1998 Geddes et al.
5,769,311 A 6/1998 Morita et al.
5,775,577 A 7/1998 Titus
5,794,842 A 8/1998 Hallam
5,794,843 A 8/1998 Sanchez
5,810,243 A 9/1998 DiPinto et al.
5,839,653 A 11/1998 Zadravetz
5,857,615 A 1/1999 Rose
5,927,502 A 7/1999 Hunter
5,928,764 A 7/1999 Costi
5,950,917 A 9/1999 Smith
5,952,068 A 9/1999 Neale et al.
5,964,400 A 10/1999 Varano et al.
6,039,682 A 3/2000 Dees et al.
6,068,182 A 5/2000 Tokunaga
6,085,970 A 7/2000 Sadlier
6,109,518 A 8/2000 Mueller et al.
6,116,503 A 9/2000 Varano
6,126,584 A 10/2000 Zadravetz
6,139,665 A 10/2000 Schmelzer et al.
6,142,331 A 11/2000 Breining et al.

| | | | | |
|---|---|---|---|---|
| 6,179,203 | B1 | 1/2001 | Toussant et al. | |
| 6,186,394 | B1 | 2/2001 | Dees et al. | |
| 6,193,098 | B1 | 2/2001 | Mochizuki et al. | |
| 6,196,454 | B1 | 3/2001 | Sadlier | |
| 6,213,293 | B1 | 4/2001 | Marco | |
| 6,224,954 | B1 | 5/2001 | Mitchell et al. | |
| 6,250,545 | B1 * | 6/2001 | Mazzarolo et al. | 229/403 |
| 6,253,995 | B1 | 7/2001 | Blok et al. | |
| 6,257,485 | B1 | 7/2001 | Sadlier et al. | |
| 6,260,756 | B1 | 7/2001 | Mochizuki et al. | |
| 6,265,040 | B1 | 7/2001 | Neale et al. | |
| 6,267,837 | B1 | 7/2001 | Mitchell et al. | |
| 6,277,454 | B1 | 8/2001 | Neale et al. | |
| 6,287,247 | B1 | 9/2001 | Dees et al. | |
| 6,290,091 | B1 | 9/2001 | Bell | |
| 6,308,883 | B1 | 10/2001 | Schmelzer et al. | |
| 6,343,735 | B1 | 2/2002 | Cai | |
| 6,378,766 | B2 | 4/2002 | Sadlier | |
| 6,416,829 | B2 | 7/2002 | Breining et al. | |
| 6,419,105 | B1 | 7/2002 | Bruce et al. | |
| 6,422,456 | B1 | 7/2002 | Sadlier | |
| 6,450,398 | B1 * | 9/2002 | Muise et al. | 229/939 |
| 6,565,934 | B1 | 5/2003 | Fredricks et al. | |
| 6,568,585 | B2 | 5/2003 | Marie | |
| 6,586,075 | B1 | 7/2003 | Mitchell et al. | |
| 6,595,409 | B2 | 7/2003 | Hashimoto et al. | |
| 6,598,786 | B1 | 7/2003 | Guo | |
| 6,663,926 | B1 | 12/2003 | Okushita et al. | |
| 6,663,927 | B2 | 12/2003 | Breining et al. | |
| 6,703,090 | B2 | 3/2004 | Breining et al. | |
| 6,749,913 | B2 | 6/2004 | Watanabe et al. | |
| 6,811,843 | B2 | 11/2004 | DeBraal et al. | |
| 6,852,381 | B2 | 2/2005 | Debraal et al. | |
| 6,926,197 | B2 | 8/2005 | Hed et al. | |
| 7,045,196 | B1 | 5/2006 | Hill | |
| 2001/0048022 | A1 * | 12/2001 | Zoeckler | 229/199 |
| 2003/0071045 | A1 | 4/2003 | Taylor | |
| 2004/0140047 | A1 | 7/2004 | Sato et al. | |
| 2006/0118608 | A1 | 6/2006 | Stahlecker | |
| 2006/0144915 | A1 | 7/2006 | Sadlier | |
| 2006/0289610 | A1 | 12/2006 | Kling | |

FOREIGN PATENT DOCUMENTS

| | | | |
|---|---|---|---|
| CH | 0568053 | A | 10/1975 |
| DE | 1912705 | A1 | 10/1969 |
| DE | 1786171 | | 2/1972 |
| DE | 2330767 | | 1/1975 |
| DE | 2331005 | | 1/1975 |
| DE | 2418141 | A1 | 10/1975 |
| EP | 0371918 | A1 | 6/1990 |
| FR | 993163 | | 10/1951 |
| FR | 1373348 | | 10/1963 |
| FR | 2206240 | | 6/1974 |
| FR | 2397987 | | 2/1979 |
| FR | 2481229 | | 10/1980 |
| FR | 2733209 | | 10/1996 |
| GB | 604794 | | 6/1948 |
| GB | 649299 | | 1/1951 |
| GB | 958388 | | 5/1964 |
| GB | 1167861 | | 10/1969 |
| GB | 1366310 | | 9/1974 |
| GB | 2016640 | A | 9/1979 |
| GB | 2294021 | B | 8/1998 |
| IT | 334302 | | 1/1936 |
| JP | 52-14830 | | 12/1977 |
| JP | 57-6333 | | 2/1982 |
| JP | 61-142419 | A | 6/1986 |
| JP | 4-5036 | | 1/1992 |
| JP | 4-6036 | | 1/1992 |
| JP | 4-41815 | | 4/1992 |
| JP | 4-97018 | | 9/1992 |
| JP | 5-4670 | | 1/1993 |
| JP | 6-22212 | | 3/1994 |
| JP | 6-39717 | | 5/1994 |
| JP | 6-61773 | | 8/1994 |
| JP | 6-78215 | | 11/1994 |
| JP | 7-189138 | | 7/1995 |
| NL | 291640 | | 7/1965 |

OTHER PUBLICATIONS

Marilyn Bakker, The Wiley Encyclopedia of Packaging Technology, 1986, 66-69; USA.

U.S. Appl. No. 11/182,330 filed Jul. 15, 2005 to Sadlier.

* cited by examiner

MULTI-LAYERED CONTAINER HAVING INTERRUPTED CORRUGATED INSULATING LINER

FIELD OF THE INVENTION

The present invention relates to insulated containers useful for serving, for example, hot beverages. Specifically, the present invention relates to multilayer containers comprising a corrugated sheet as an inner insulating liner, wherein the liner comprises interruptions.

BACKGROUND OF THE INVENTION

Multi-layered insulated containers made from folded blanks are disclosed in the following U.S. Pat. Nos. 5,660,326, 5,697,550, 5,964,400 6,085,970, 6,196,454, 6,257,485, 6,378,766 and 6,422,456, which disclosures are incorporated herein in their entireties by this reference. Although the inner and outer portions of the container (that is, the sidewall) are prepared from a single blank, when assembled, the sidewalls of such containers effectively comprise three layers due to an insulating liner being sandwiched between the folded inner and outer layers. One version of the insulating container disclosed in the referenced patents is sold currently under the INSULAIR® brand name.

In use, such a corrugated insulating liner has been found to provide superior insulating character through the presence of air space between the inner and outer layers of the blank. When filled with a hot liquid, such as coffee or tea, the air space substantially prevents the transfer of heat from the liquid to the hands of the consumer. The INSULAIR container has received wide acceptance in the marketplace due to its exemplary insulation characteristics.

While a corrugated liner provides suitable air space for superior insulation in the assembled INSULAIR container, it has been found that if the corrugations become spread or collapse, the insulating character of the container can be reduced. Such spreading or collapsing can generally occur during one or more of: a) storage of the blanks prior to conversion into a container; b) manufacture of the container; or c) during storage of the container by nesting or stacking a plurality of containers prior to use. When the blanks or finished containers are located at or near the bottom of a stack, the spread or collapse of the corrugated insulating layer can be quite acute due to the weight of the upper blanks or containers in the stack on the lower blanks or containers in the stack.

The decreased efficiency of insulation resulting from spread or collapse of the insulating liner is believed to be due to the decrease in the amount of effective air space between the inner and outer layers of the container. For example, the inventors have found that a liner having a corrugation thickness of about 0.040 inches upon manufacture of the liner can lose as much as 0.03 inches in corrugation thickness when the blanks are stacked for a few days prior to conversion into a container.

In typical corrugation applications, such as in the manufacture of boxes, the problem of corrugation spread or collapse is generally addressed by applying glue to the peaks (and/or valleys) of the corrugations prior to application of one or two outer sheets of paper to provide the corrugated material for use. The glue substantially prevents the flutes of the corrugated liner from spreading or collapsing. However, because the blank used to make the INSULAR multilayer container must be wound on a mandrel, it is not readily possible to use the gluing technique to reduce or prevent the spread or collapse of the insulating liner.

Moreover, while INSULAIR containers are presently the most prevalent multilayer container in the market, other multilayer containers having insulating layers have been proposed in, for example, U.S. patent application Ser. Nos. 11/283,772 and 11/182,330, the disclosures of which are incorporated herein in their entireties by this reference. Further examples of multi-layered corrugated container are set forth in U.S. Pat. Nos. 5,839,653 and 6,253,995, the disclosures of which are incorporated herein in their entireties by this reference. It is expected that any reduction in the integrity of the corrugation in such multi-layer containers would also decrease the effectiveness of insulation.

Accordingly, it would be desirable to develop a method to reduce the propensity of a corrugated insulating liner incorporated in a multi-layer container to spread or collapse in storage or use. Still farther, it would be desirable to obtain a corrugated liner for use in a multi-layer container, where that liner exhibits a reduced propensity to spread or collapse in storage or use.

SUMMARY OF THE INVENTION

The present invention relates to an insulating container prepared having a corrugated insulating liner disposed between an inner and outer layer, wherein the inner and outer layers comprise the sidewalls of a multi-layer container, and wherein the corrugated insulating liner comprises an interrupted corrugate pattern. This interrupted corrugate pattern provides improved insulation in an assembled multi-layer container comprising the corrugated insulating liner in that the corrugated sheet shows a lesser propensity to spread or collapse in use. Still further, the present invention provides a method to make a container that includes this corrugated insulating liner.

Additional advantages of the invention will be set forth in part in the detailed description, which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory aspects of the invention, and are not restrictive of the invention, as claimed.

DETAILED DESCRIPTION OF THE INVENTION

The present invention may be understood more readily by reference to the following detailed description of the invention and the Figures provided herein. It is to be understood that this invention is not limited to the specific methods, components and conditions described, as such may, of course, vary. It is also to be understood that the terminology used herein is for the purpose of describing particular aspects only and is not intended to be limiting.

In this specification and in the claims that follow, reference will be made to a number of terms, which shall be defined to have the following meanings.

The singular forms "a," "an," and "the" include plural referents unless the context clearly dictates otherwise.

Ranges may be expressed herein as from "about" one particular value and/or to "about" or another particular value, when such a range is expressed, another aspect includes from the one particular value and/or to the other particular value. Similarly, when values are expressed as approximations, by use of the antecedent "about," it will be understood that the particular value forms another aspect.

"Optional" or "optionally" means that the subsequently described event or circumstance may or may not occur, and that the description includes instances where said event or circumstance occurs and instances where it does not.

Figure 1:
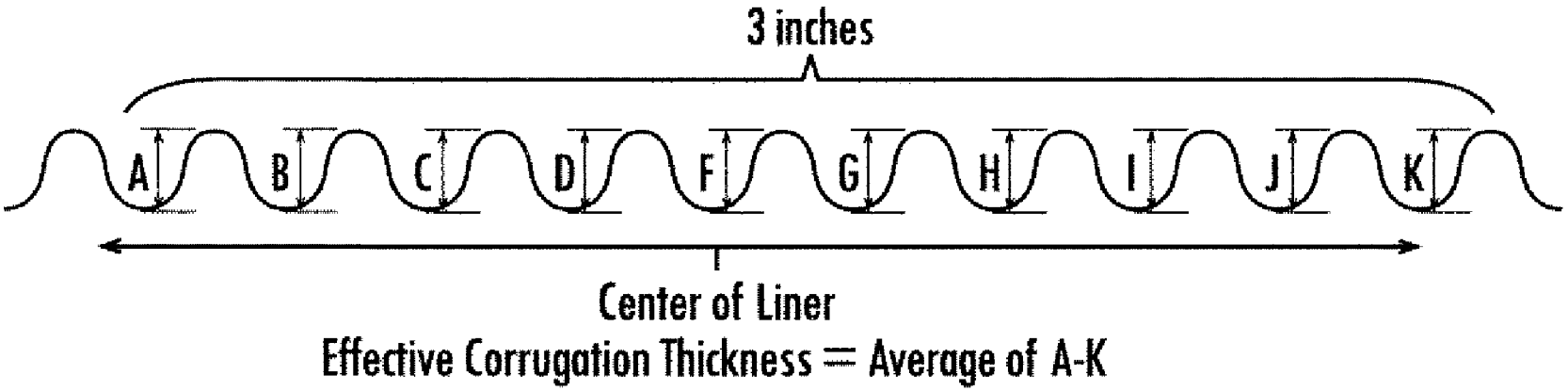
FIG. 1 illustrates the manner in which effective corrugation thickness is measured in accordance with the invention.

"Effective corrugate thickness" means the average height from the top of one flute (peak) to the bottom of an adjacent flute (valley) in a corrugated liner, where the height is averaged over a distance of about 3 inches on the liner, where the center point of the measurement corresponds to the center point of the corrugated liner. This measurement is illustrated in FIG. 1.

The present invention relates to a multi-layer container comprising an inner and an outer layer and having a corrugated insulating liner disposed therebetween. The container sidewalls can be prepared from a folded blank or from separate inner and outer blanks; these are discussed further herein. The corrugated insulating liner of the present invention comprises interruptions oriented approximately transverse to the corrugations.

"Interruptions" means a lack of stretching, embossing and/or corrugation in a certain area of the sheet such that the sheet is substantially flat or smooth in the interrupted area.

"Approximately transversing" means that the interruptions can be oriented about perpendicular to the corrugations. Alternatively, "approximately transversing" means that the interruptions are oriented so that they run across the corrugations and thereby the corrugations exhibit a lesser propensity to spread or collapse during container manufacture, storage and/or use; these interruptions can be perpendicular to the corrugations or otherwise. The interruptions of the otherwise continuous corrugation pattern have been found to provide significantly improved insulation in an assembled multi-layer container having a hot beverage contained therein.

In one aspect, the corrugated insulating liner can be formed by stretching of a paperboard sheet material, rather than bending or folding it. This is in contrast to the more typical method of preparing corrugated paperboard. Such typical methods start with a sheet of smooth paper and bending or folding it in a series of "V" shaped flutes by running it through a set of gears The peaks and valleys of the resulting corrugate pattern run lengthwise across the width of the web. This typical method of corrugation can be inefficient in that up to about 40% is required to provide a width comparable to the width of the sheet prior to corrugation.

Figure 2:
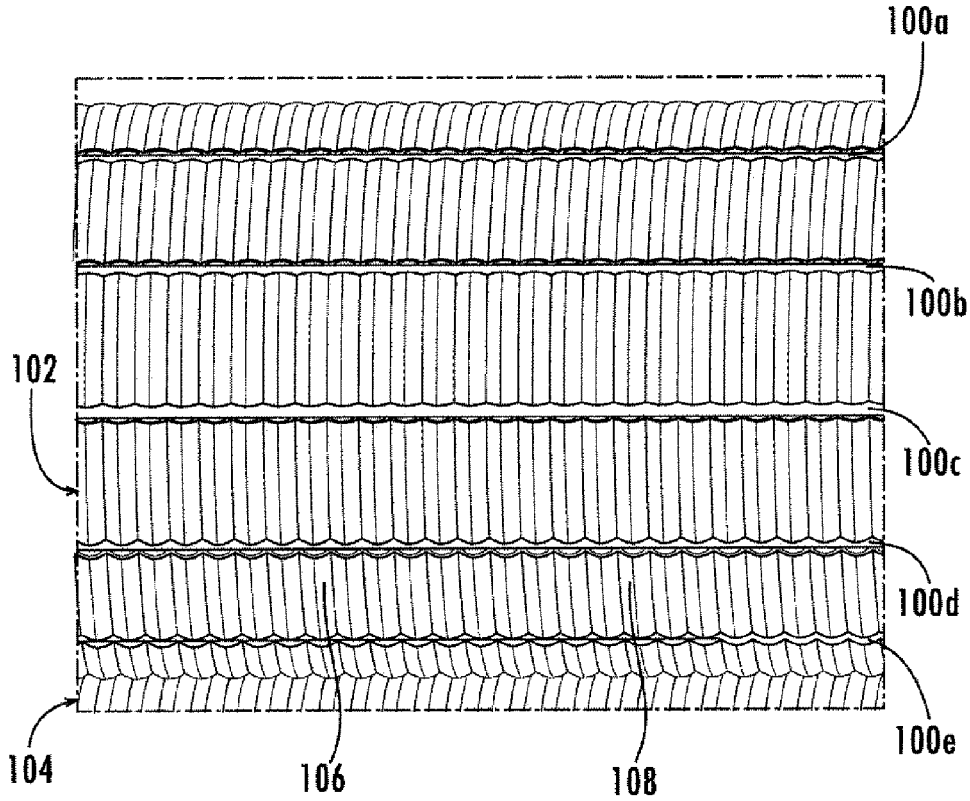
FIG. 2 shows the embossing die used in the present invention.

In the stretching method, the corrugated insulating liner can be prepared by advancing a smooth sheet of paperboard through a set of embossing dies where the peaks and valleys of the die, and the resulting corrugate pattern, run lengthwise with the length of the web. An em bossing die suitable for use in the present invention is pictured in FIG. 2. In FIG. 2 interruptions 100*a*, 100*b*, 100*c*, 100*d* and 100*e* are visible transversing the peaks and valleys of embossing die 102; such interruptions are positioned at predetermined spaced intervals around the diameter of the upper embossing die. A corrugated pattern is applied to paperboard web (not shown) by directing the paperboard web (not shown) between upper embossing die 102 and lower embossing die 104. Both lower and upper embossing dies 102 and 104 comprise raised areas 106 and recessed areas 108. The raised and recessed areas of the lower embossing die are not transversed by interruptions.

A dual embossing and die cutting station suitable for use in the present invention is manufactured by Tools and Productions (Temple City. Calif.). Suitable embossing dies are available from CSC Manufacturing (Modesto, Calif.).

As a result of this configuration, the paperboard is stretched. In some aspects, the paperboard web can be directed through a steam box prior to embossing to enhance stretching, although this step is not necessary unless the ambient humidity is very low and/or the paperboard web is somewhat dry. The embossing process has been found by the inventor herein to require significantly less paperboard to prepare the corrugated insulating liner because the stretching of the sheet compensates for the dimensional losses in the sheet resulting from corrugation of the sheet. The web can be directed through the steam box (optional) and the embossing dies at various speeds, which depend largely on the desired speed of the operation.

In a surprising discovery of the present invention, the inventors herein have determined that using the embossing method herein it is possible to emboss the corrugated insulating liner using up to about 75% to less pressure on the embossing dies. For example, it was found that that a corrugated insulating liner having a thickness of about 0.040 inches using an embossing die pressure of about 1000 psi (pounds per square inch), as opposed to about 4000 psi seen in the prior art. This was found to reduce the wear on the bearings and journals of the embossing die.

Without being bound by theory, it is believed that when the embossing process does not include the interruptions disclosed herein, the paperboard needs to be compressed to deeper than the desired final corrugation thickness. For example, if a final effective corrugate thickness will be about 0.040 inches, the depth of the embossing die not including the interruptions should be about 0.047 inches in order to compensate for corrugate relaxation. This deeper pattern has been found to require the application of about 4000 psi of pressure on the embossing die in order to affect the desire effective corrugate thickness. It has been found that the inclusion of interruptions in the embossing die, the corrugated paperboard is significantly less likely to experience relaxation and lose effective corrugate thickness.

To provide the corrugated insulating liner having the interrupted corrugate pattern, the embossing die comprises a pattern suitable for imparting the interrupted pattern to the paperboard. In one non-limiting example, the embossing die can have a series of from about 0.125" wide grooves cut into the die at intervals of about 1 inch apart around the diameter of the upper embossing die 102. Resulting from this pattern will be the inventive corrugated insulating liner having a pattern like that illustrated in FIG. 4.

Figure 3:
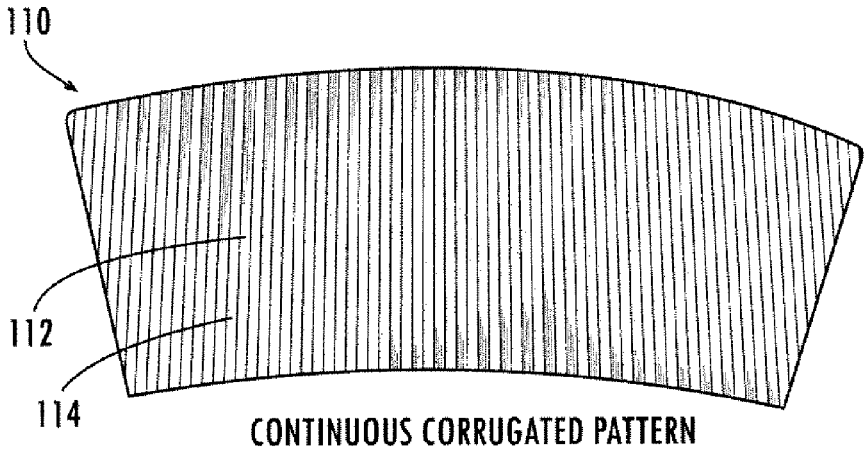
Fig. 3 (Prior Art)
FIG. 3 illustrates a prior art corrugated insulating liner not having interruptions.

FIG. 3 illustrates a prior art corrugation pattern using embossing. Corrugated paperboard sheet 110 which is cut from a paperboard web (not shown) comprises a corrugate pattern having peaks 112 and valleys 114 across the surface of the sheet. In contrast, the corrugated paperboard sheet 116 of FIG. 4 includes peaks 118 and valleys 120, as well as interruptions 122*a*, 122*b*, 122*c* and 122*d* that transverse corrugated paperboard sheet 116 that has been cut from a paperboard web (not shown). The embossing die can have a diameter of from about 3 to about 10 inches.

The corrugations in the corrugated insulating liner of the present invention can have a pitch (that is, the spacing between tops of adjacent ribs) of from about 2 mm to about 14 mm. The depth of the corrugations can be from about 0.5 to about 3.0 mm. The dimensions of the pitch and depth of the corrugations are directly related to the effective corrugate thickness as discussed previously herein and which is illustrated in FIG. 1.

The interruptions can have a width of from about 2 mm to about 10 mm. In a further aspect, the interruptions suitably reduce the propensity of the corrugated liner to spread or collapse during assembly, storage or use of the container.

Due to the significantly decreased propensity of the corrugated insulating liner to spread or collapse seen with the embossing technique of the present invention, it is believed that it is possible to fabricate a multi-layer container having substantially increased insulation properties. That is, the interruptions allow a thicker corrugate sheet to be included within the inner and outer sidewalls of a multi-layer insulated container without the sheet becoming spread or crushed during manufacture or, storage and/or use of the container.

While the embossing technique discussed above allows the use of substantially less paperboard when preparing the corrugated insulating liner of the present invention, traditional methods of corrugating can be used in accordance with the present invention. Such methods of corrugation are known to one of skill in the art and, as such, are not discussed in detail herein.

In a further aspect, the corrugated insulating liner is prepared from paperboard having a thickness of from about 0.1 to about 0.6 mm thick. Yet further, the corrugated insulating liner is prepared from paperboard having a caliper of from about 0.2 to about 0.4 mils.

The corrugated insulating liner can be prepared from paperboard comprising substantially virgin fibers. Yet further, the corrugated insulating liner can be prepared from paperboard comprising a mixture of virgin and recycled fibers. In a further aspect, the corrugated insulating liner can be prepared from paperboard comprising substantially recycled fibers. "Recycled" means post-consumer recycled fibers, manufacturer-derived recycled fibers or a mixture thereof. Specifically, in non-limiting examples, the corrugated insulating liner can comprise plate stock paperboard, cup stock, Kraft paper, or linerboard. The corrugated insulating liner can optionally be coated with a layer of reflective material such as metallized film or foil using conventional methods. The corrugated insulating liner can also comprise perforations therein.

Figure 4:
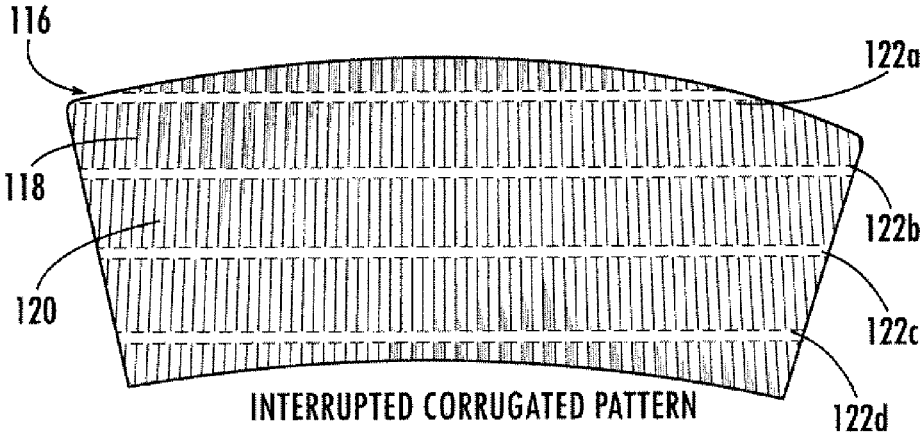
FIG. 4 illustrates a corrugated insulating liner having interruptions.

When the interrupted corrugated pattern has been imparted to the paperboard web, the corrugated insulating liner is cut from the corrugated paperboard in the desired shape. Such a desired shape is illustrated in FIGS. 3 and 4 herewith. For example, the corrugated insulating liner can have slightly curved upper and lower edges (which will be oriented to the upper and lower edges of the sidewall blank) wherein the upper length is longer at the top edge than at the lower edge of the liner. The corrugated insulating liner can be cut from the paperboard web using known methods, with care being taken to avoid crushing or collapsing the corrugate at the edges during cutting.

The corrugated insulating liner can be cut from the paperboard web such that the corrugated portion is oriented from top to bottom of the finished container when the sidewall assembly (that is, the inner and outer layers with the corrugated insulating liner therebetween) is incorporated into a finished container. Alternatively, the corrugated insulating liner can be cut such that the corrugated portion is oriented laterally when the corrugated insulating liner is incorporated into a finished container. This lateral assembly is disclosed, for example, in U.S. Pat. No. 6,253,995, previously incorporated by reference.

The corrugated insulating liner can be from about 10% to about 70% smaller in area than the area of the sidewall container blank(s). Still further, the corrugated insulating liner can be from about 20% to about 40% smaller in area than the area of the sidewall container blank(s). Due to the smaller size of the corrugated insulating liner, even if it is not precisely centered on the base sheet as often happens with high-speed assembling machinery, the sidewall container blank(s) comprising the corrugated insulating liner will still be useable since the sidewall blank will still extend beyond the edges of the insert. Thus, it is generally beneficial, but not crucial, to have precise placement of the corrugated insulating liner on the container blank(s) during assembly of the multi-layer container.

The inner and outer layers of the insulated container can comprise a folded sidewall blank as set forth in U.S. Pat. Nos. 5,660,326, 5,697,550, 5,964,400 6,085,970, 6,196.454, 6,257,485, 6,378,799 and 6,422,456, which were previously incorporated by reference. Alternatively, the inner and outer layers can comprise two separate sidewall blanks as set forth, for example, in U.S. patent application Ser. Nos. 11/182,330 and 11/283,772, which disclosures were previously incorporated by reference. Other examples of two separate sidewall blanks are disclosed in U.S. Pat. Nos. 5,839,653 and 6,253,995, which disclosures were previously incorporated by reference.

If made from paper, the inner and outer layers that comprise the multi-layered insulated containers can be solid bleach sulfite (SBS) paperboard that is coated on at least one side with polyethylene or any other suitable water proof material. The methods of coating the sidewall blanks, bottom blanks, or finished containers are known to one of ordinary skill in the art and, as such, are not discussed further herein.

Whether a folded sidewall blank is used or there are separate sidewall blanks to comprise the inner and outer layers of the multi-layer sidewall blank, glue can be used to adhere the corrugated insulating liner to an interior of the sidewall blank surface. This gluing is disclosed, for example, in U.S. patent application Ser. No. 11/182,330, which disclosure is incorporated herein in its entirety by this reference. In this aspect, a small amount of glue can be placed in a central area of, and be substantially centered on, the folded sidewall blank.

If the corrugated insulating liner has a reflective coating on one side, the reflective side would be positioned such that it would face toward the center of the finished cup. In one aspect, less than about 20% of the area of the corrugated insulating liner can be adhesively attached to the sidewall blank. Since the insert sheet is smaller than the sidewall blank, edge portions of the blank will extend beyond the edges of the insert. A suitable adhesive can be hot melt adhesive because of its fast set time. Alternatively, adhesive can be placed directly on the corrugated insulating liner. As a further alternative, several glue spots can be used in a central area of the interior of the sidewall blank to provide more stability to the insert as it is attached with high speed machinery.

If made from plastic, the inner and outer sidewall layers need not have a side seam, and can be formed from any of a number of materials, or combination of materials, such as PET, PP, PS, and/or HDPE. The process of making single-wall plastic cups from a thermoforming or injection molding process is well known. Different material combinations and thicknesses can be used to achieve certain properties. For example, if an insulated cup with a long shelf life is required, the plastic cup can be made from a combination of HDPE and EVOH. The HDPE provides a moisture barrier which increases with the thickness of the material, and the EVOH provides an oxygen barrier. If a microwavable container is required, HDPE or PP can be used, both of which are resistant to high levels of heat.

Methods of assembling a folded sidewall container blank comprising a corrugated insulating liner are disclosed with respect to the folded blank disclosed in U.S. Pat. Nos. 5,660,326, 5,697,550, 5,964,400 6,085,970, 6,196,454, 6,257,485, 6,378,799 and 6,422,456, previously incorporated by reference. Specifically useful methods of assembling a container from a folded sidewall blank include the gluing of the folded blank adjacent the fold line using a folder-gluer machine. Also useful are removal of a notch of material at the upper and lower edges of the outer layer of the folded sidewall blank so as to permit a tighter seal. Yet further useful techniques include skiving a predetermined thickness of material along the fold line and resulting folded sideseam edge to allow the seam to form a tighter seal.

When assembling a multi-layer container from separate inner and outer sidewall blanks, methods such as those disclosed, for example, in U.S. patent application Ser. Nos. 11/182,330 and 11/283,772 and U.S. Pat. Nos. 5,839.653 and 6,253,995, previously incorporated by reference, can be used.

When assembled into a finished container, the inclusion of interruptions in the corrugated insulating liner has been found to substantially decrease the propensity of the corrugations to spread or collapse during manufacture. For example, when a folded sidewall blank is assembled with the corrugated insulating liner situated therebetween, unless there is a precise control of the folder device to define the finished cup wall thickness, the layers can be folded too tightly. This too tight folding will then generally cause an uninterrupted corrugated insulating liner to be crushed when the blank is wrapped around a mandrel in forming the finished container. This crushing will, in turn, result in less space being located between the inner outer sidewalls and, as a result, lesser insulating quality in the finished container.

Also, stacking of the sidewall blanks prior to conversion into containers (assuming a blank fed operation is used), can cause the spread or collapse of the corrugated insulating liner. For example, the stacking of blanks having a corrugated insulating liner with an initial thickness of 0.040 inches has been found by the inventor herein to lose about 0.003 inches in thickness in a few days. The presence of interruptions on the corrugated insulating liner of the present invention has been found to reduce the propensity of the corrugated insulating liner to exhibit spread or collapse during storage.

Still further, the nesting or stacking of containers prior to use can cause the corrugated insulating liner to spread or collapse prior to use. The presence of interruptions in the corrugated insulating liner in accordance with the present invention has been found to reduce the propensity of the corrugated insulating liner to spread or collapse during storage.

When the corrugated insulating liner has the interruptions of the present invention, it has been found that the insulating character of the assembled multi-layered container is about 2 degrees F. improved over the non-interrupted corrugated insulating liner.

The inventive corrugated insulating liner has a target effective corrugation thickness of about 0.040 inches. When included in an assembled container, the corrugated insulating liner having this target thickness will provide an about 0.030 inch air pocket between the inner and outer layers of the assembled container to provide insulation in the finished container. If the thickness is decreased about 0.003 inches as a result of the spread or collapse of the corrugated insulating liner, the air pocket will be decreased about 10% over a corrugated insulating liner that has not spread or collapsed. Thus, the corrugated insulating liner of the present invention provides about a 10% overall improvement in insulation quality over multi-layer containers not including the inventive corrugated insulating liner.

It will be apparent to those skilled in the art that various modifications and variations can be made in the present invention without departing from the scope of the invention. Other aspects of the invention will be apparent to those skilled in the art from consideration of the specification and practice of the invention disclosed herein. It is intended that the specification and examples be considered as exemplary only.

What is claimed is:

1. A method for making a sidewall container assembly suitable for a multi-layer insulated container, comprising;

providing an insulating liner by embossing a substrate to provide a pattern having a plurality of peaks and valleys and at least one interruption that is approximately transversing the pattern, wherein the interruption is substantially flat and has a width of about 2 mm to about 10 mm, wherein the substrate is embossed by advancing the substrate through a set of dies, each die having a plurality of raised and recessed areas to provide the pattern of peaks and valleys, and wherein at least one of the dies comprises one or more approximately transversing interruptions formed therein to provide the at least one interruption; and positioning the insulating liner within a sidewall container assembly.

2. The method of claim 1, further comprising preparing a container from the sidewall container assembly comprising the insulating liner.

3. The method of claim 1, wherein the sidewall container assembly comprises an inner layer having an interior side and an exterior side, and an outer layer having an interior side and an exterior side.

4. The method of claim 3, wherein the inner and outer layers are derived from a folded sidewall blank.

5. The method of claim 3, wherein the inner and outer layers are derived from two sidewall blanks.

6. The method of claim 1, wherein the liner comprises from about 2 to about 5 interruptions.

7. The method of claim 1, wherein the liner has an effective insulation thickness of from about 0.030 inches to about 0.070 inches.

8. The method of claim 1, wherein the pattern comprises corrugations having a pitch of from about 2 mm to about 14 mm.

9. The method of claim 1, wherein the pattern comprises corrugations having a depth of from about 0.5 mm to about 3.0 mm.

10. The method of claim 1, wherein the liner is glued to either the inner or outer layers, or both the inner and outer layers.

11. The method of claim 1, wherein each interruption has a width of from about 2 mm to about 10 mm.

12. A method for making an insulating layer for a container, comprising;

embossing a substrate to provide a pattern having a plurality of peaks and valleys and at least one interruption that is approximately transversing the pattern, wherein the interruption is substantially flat and has a width of about 2 mm to about 10 mm, wherein the substrate is embossed by advancing the substrate through a set of dies, each die having a plurality of raised and recessed areas to provide the pattern of peaks and valleys, and wherein at least one of the dies comprises one or more approximately transversing interruptions formed therein to provide the at least one interruption.

* * * * *